US005816180A

United States Patent [19]

Hoyt

[11] Patent Number: 5,816,180

[45] Date of Patent: Oct. 6, 1998

[54] ROTATING RIG

[76] Inventor: John Garrison Hoyt, 17 Hammersmith Rd., Unit 1C, Newport, R.I. 02840

[21] Appl. No.: 855,406

[22] Filed: May 13, 1997

[51] Int. Cl.[6] ..... B63B 15/00

[52] U.S. Cl. ..... 114/89; 114/90; 114/97

[58] Field of Search ..... 114/39.1, 89–91, 114/93, 102, 103

[56] References Cited

U.S. PATENT DOCUMENTS

| | | | |
|---|---|---|---|
| 641,321 | 1/1900 | Perkins | 114/91 |
| 647,703 | 4/1900 | Pool | 114/91 |
| 3,085,539 | 4/1963 | Prolss | 114/91 |
| 4,337,714 | 7/1982 | Dougherty | 114/90 |
| 4,940,008 | 7/1990 | Hoyt | 114/90 |
| 5,197,401 | 3/1993 | Finley et al. | 114/91 |

FOREIGN PATENT DOCUMENTS

| | | | |
|---|---|---|---|
| 2552-390-A | 9/1983 | France . | |
| 3445-146-A | 12/1984 | Germany . | |
| 4596 | 1/1989 | Japan | 114/90 |

*Primary Examiner*—Ed L. Swinehart
*Attorney, Agent, or Firm*—Barlow & Josephs, Ltd.

[57] ABSTRACT

A rig on a sailboat adapted to be mounted on a deck or cabin top of the boat, the rig having a mast, mast step, vertical stabilizing structure for the mast. The rig is mounted for rotation about a center and may be provided with more than one mast.

4 Claims, 4 Drawing Sheets

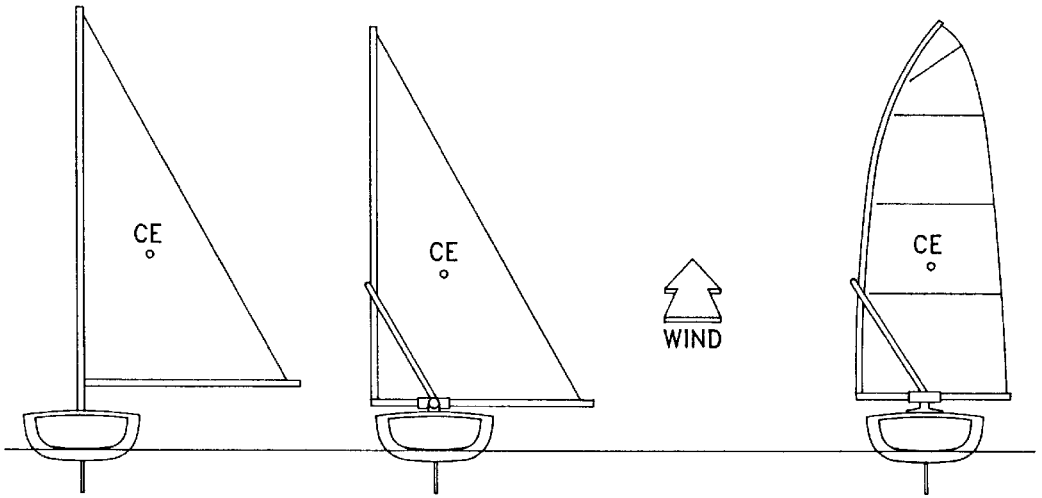
FIG. 4
FIG. 4B
FIG. 4D
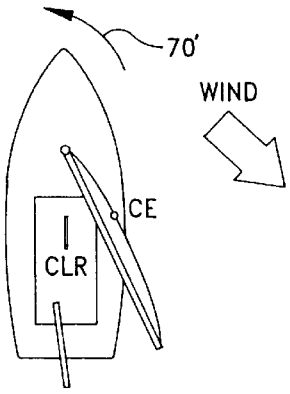
FIG. 4'
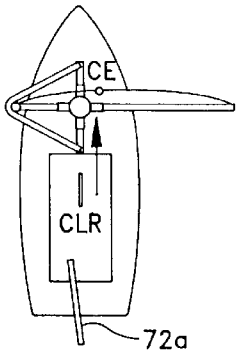
FIG. 4B'
FIG. 4C
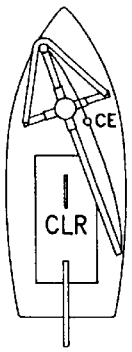
FIG. 4D'

ROTATING RIG

BACKGROUND OF THE INVENTION

There have been some suggestions in the prior art of adjusting the position of the mast relative to the hull of the sailboat. Perkins U.S. Pat. No. 641,321 is an early attempt to move the position of the mast, primarily to windward for the avowed purpose of balancing the boat. The Dougherty U.S. Pat. No. 4,337,714 is another example of a mast moveable on a track transversely of the hull again to move the weight of the mast to windward. Other disclosures are found in French Specification 2,552,390 and German Specification 3,445,146. Most of the prior art disclosures noted above deal with catboats, that is a single mast with one mainsail. In vessels of this type the main problem relates to sailing off the wind, that is with the sheet eased. This may be explained when it is realized that the center of effort from the sail moves outboard (over the side) that creates a turning moment (weather helm) balanced only by the rudder. When going downwind a similar situation occurs as the center of effort from the sail in a normal vessel is way outboard, again creating a weather helm as well as creating a force that tends to immerse the bow in the water.

SUMMARY OF THE INVENTION

A primary objective of the instant invention is to move the center of effort in a sailboat to a point closer to the center of lateral resistance.

A secondary objective is to provide a mast support strut that is foldable and which provides support to a mast in a position forward of the rotational center of the mast.

The above mentioned objectives are attained by providing a rotating mast assembly for a sailboat that includes a mast step and vertical stabilizing bars for the mast which can carry a high aspect ratio sail. In other aspects two mainsails may be affixed to the rotating mast assembly. This creates a beneficial aerodynamic effect by creating a "slot effect" when going up wind or to weather, with minimal beneficial effect when sailing off the wind, although it does double the sail power without raising the center of effort eased.

BRIEF DESCRIPTION OF THE DRAWINGS

FIGS. 4A, 4A', 4B, 4B', 4C and 4D are diagrammatic views showing how the center of effort is changed with use of this invention.

DETAILED DESCRIPTION OF THE INVENTION

Figure 1:
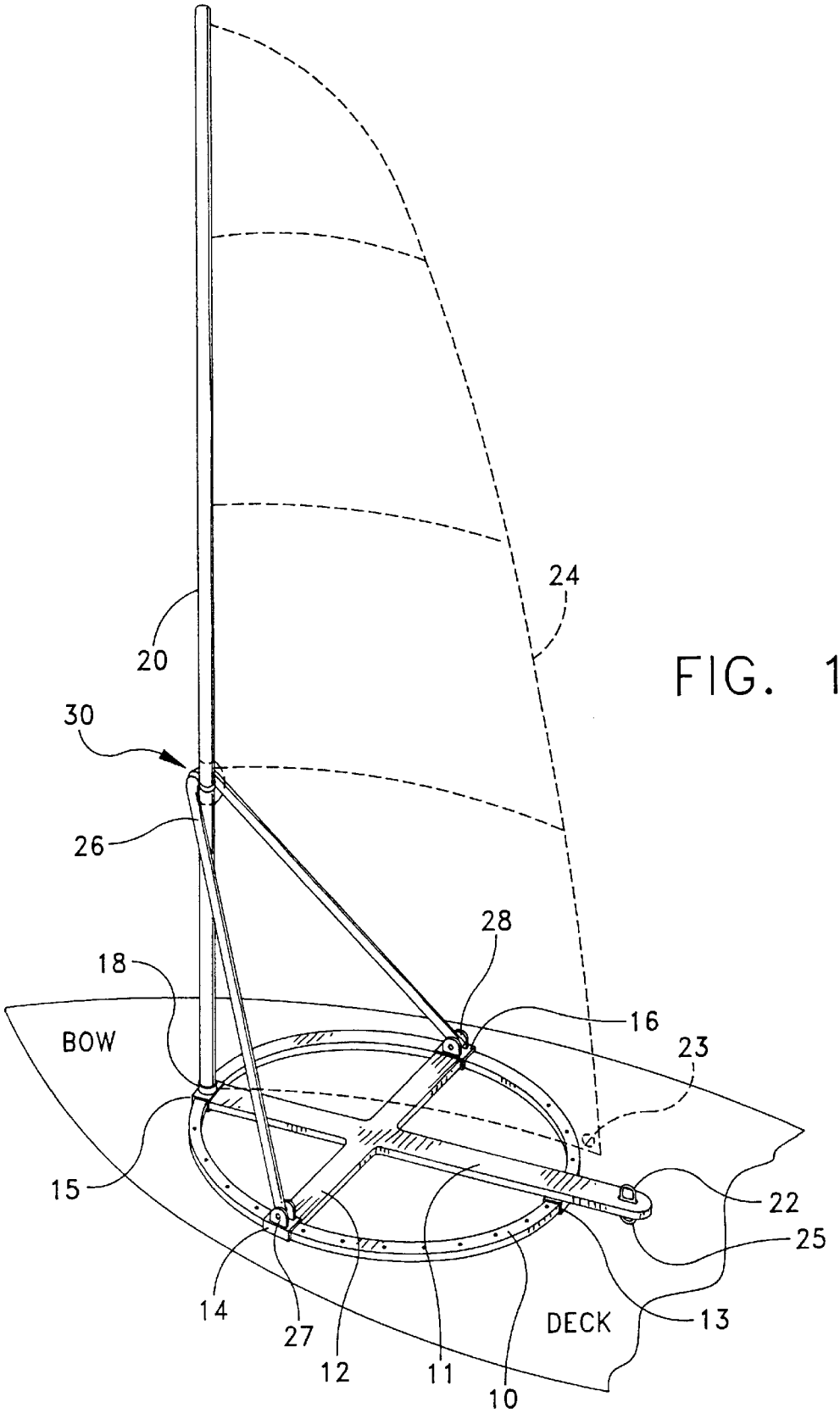
FIG. 1 is a perspective view of a rotating assembly in the form of circular track upon which is mounted a mast and struts therefore, with a sail shown in dotted lines.

Referring to FIG. 1, there is shown a track 10 that can be mounted on the deck of a sailboat or a cabin top, for example. This track is circular and supports a rotating mast assembly. The assembly is provided with a mast support and boom consisting of a cross frame made of two transverse stringer members 11 and 12, forming a cruciform, that have at their terminus track traveler cars 13, 14, 15 and 16 that grip the track. The cars are similar to genoa track cars or traveler cars well known to those skilled in the art. Ideally to accomplish this, the track is "T" shaped so that the cars grip the overhanging lips of the track.

At one terminus of member 11 is a mast step 18 that supports a mast 20 of suitable cross section, while at the other end is an eye 22 for securing the clew 23 of a sail 24. Because of this arrangement, the member 11 could be considered a boom. To stabilize the mast, a generally U shaped stabilizing bar or strut 26 is pivotally secured to each end of the member 12 in brackets 27, 28 where the legs thereof are fastened. The stabilizing bar is secured to the mast by a releasable strap means generally designated 30 at the forward facing portion of the mast. This arrangement allows the stabilizing bar to be folded and uniquely provide sideward and rearward support to the mast by virtue of the fact that the legs of the bar 26 are substantially opposite the rotational axis of the rig while the mast is forward of that axis. The sail 24, which is trimmed from point 25 on the boom 11, is supported in conventional means on the mast, well known to those versed in the art.

Figure 2:
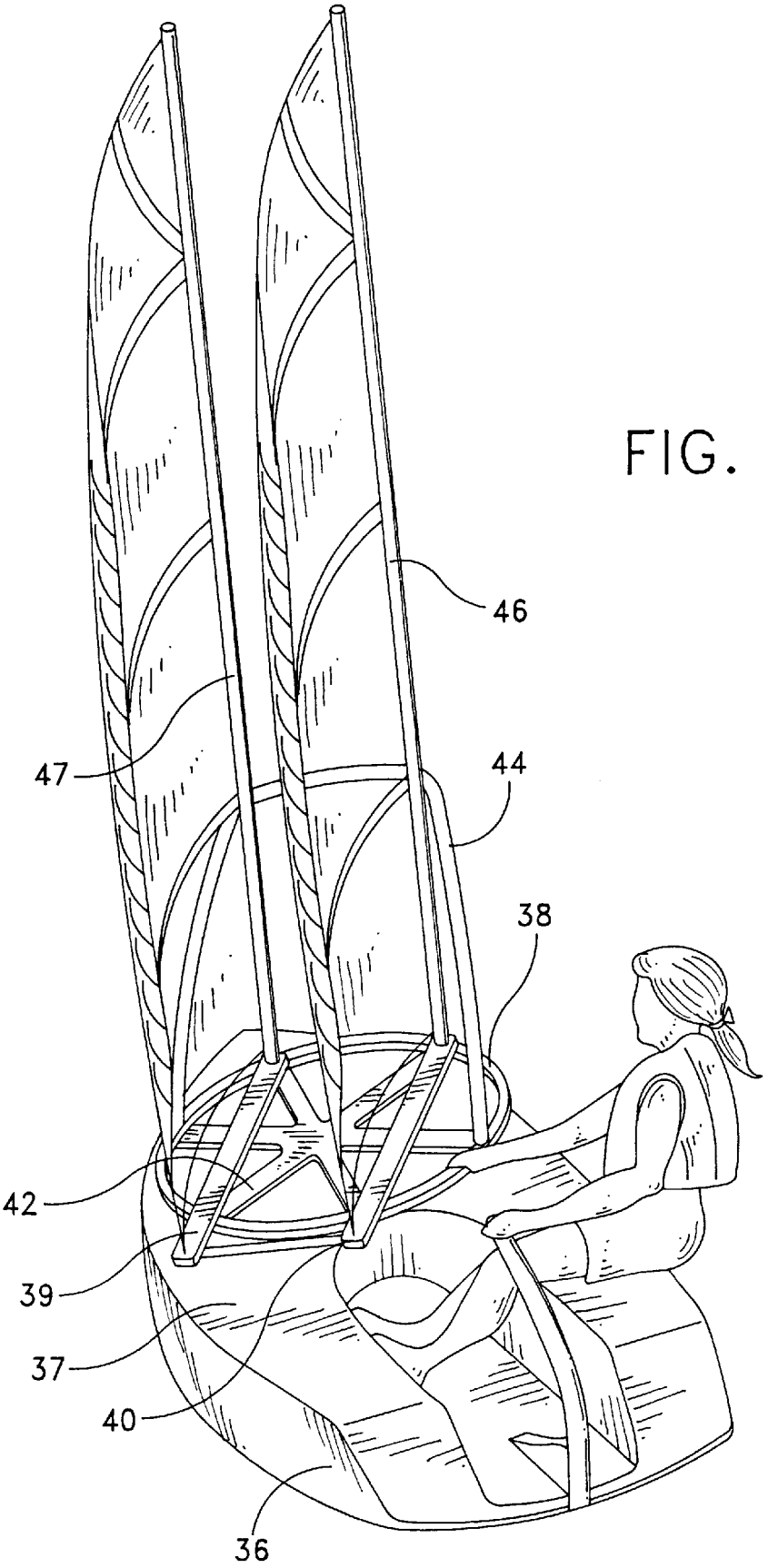
FIG. 2 is a perspective view of a similar assembly with two sails mounted on the deck of a sailboat.

FIG. 2 of the drawings illustrates a similar arrangement mounted on a sailboat 36 that has a deck 37 upon which a track 38 is secured. Rotating on the circular track 37 are two stringers or brooms 39 and 40 and bracing frame means 42. A support bar or strut 44 stabilizes the two masts 46, 47 in the same fashion as in the previous embodiment.

Figure 3:
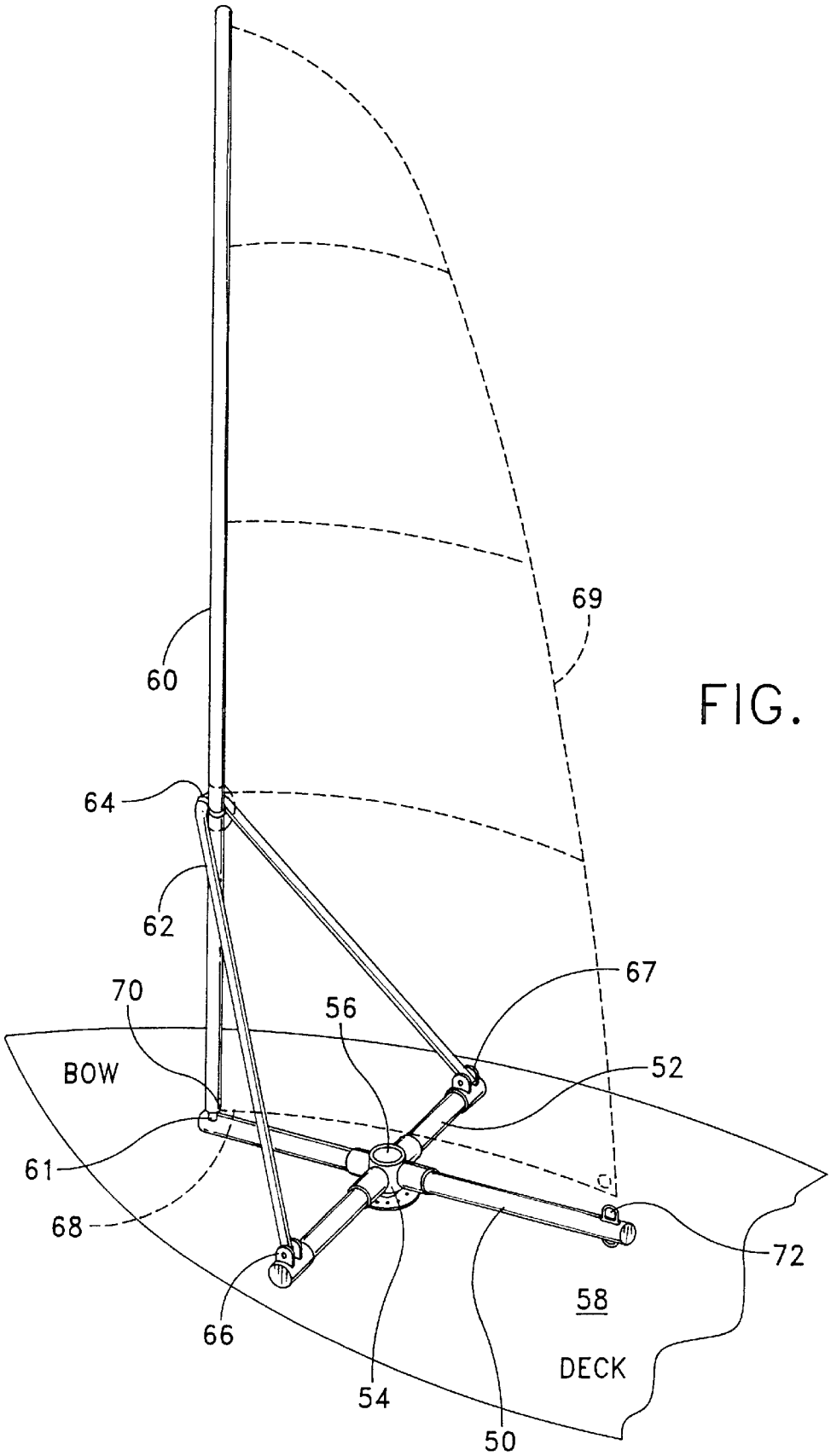
FIG. 3 is a perspective view of a modified assembly that is adapted to rotate on a bar affixed to a post, with the sail shown in dotted lines.

In FIG. 3 the concept is developed further and in this embodiment a pair of transverse members in the form of bars 50, 52 are affixed to a bearing 54 which is received on and rotates about a post 56. The post 56 is secured to the deck 58. The bar 50, or boom supports at one end a mast 60 received in a socket 61 and the stabilizing bar 62 is received in a strap means 64 on the face of the mast while the legs there of are fastened in brackets 66, 67 on the ends of bar 52. As can be readily viewed, the tack 68 of a sail 69 is fastened as at 70 while the clew 71 is fastened to the end of boom 50 as at 72.

All of the embodiments thus far described have a sail mounted on the deck of a boat in a fashion whereby there is integral control of the boom and the mast as a unit. Conventional catboats are unbalanced off the wind. Referring to FIGS. 4A, 4B, 4C, and 4D there is graphically illustrated what happens when the sail is eased out. Note how the Center of Effort "CE" moves out over the side in a conventional rig, FIGS. 4A and 4C. This automatically causes a turning moment represented by the arrows 70, 70' that must be counteracted by the rudder 72. The result is rudder drag and directional control problems. However, using the invention the problem is minimized since as the sail is eased out, FIGS. 4B and 4D, the mast is to windward creating a more balanced condition.

There are advantages to the rig illustrated in FIG. 2 that are not all that apparent. But consider that the arrangement allows for a high aspect ratio sail. In conventional rigs the mast is very tall to accommodate the high aspect ratio foil shaped sail. But if the mast is shorter and two masts are utilized, there is not only a beneficial aerodynamic effect (the slot effect) but also the masts may be shorter and with two sails, the slot effect is preserved on all settings. A unique advantage is this arrangement is that the two sails may be trimmed with one sheet. In addition a sailboat can double or triple its sail area on the same circular base.

I claim:

1. A mast and sail and displacement system for a sailboat having a hull, a deck means enclosing at least part of the hull, a circular track adapted to be affixed to the deck, a circular mast support means for holding the base of the mast at one point on the periphery thereof, said support means having means engaging the circular track, mast stabilizing means releasably connected from upper positions of the mast to portions of said support means remote from the base of the mast and means connected to the mast support means for rotating the same along said track, a sail having a head and tack defining a fore and aft rig supported on the mast, the clew thereof being attached to an opposite diametrical point on the mast support means from the base of the mast.

2. A mast displacement system as in claim 1 wherein the mast support means has means for supporting two masts on the periphery and spaced from each other, each mast having a fore and aft sail affixed thereto, the clews of each sail attached to said support at a point opposite the mast.

3. A mast assembly for a fore and aft rigged sailboat comprising a mast, and mast support means mounted on one end of a bar forming a boom that in turn rotates on a post defining a rotational axis intermediate the ends of the boom, a sail supported on the mast and having the clew thereof affixed to the other end of the boom, a transverse bar member normal to the boom affixed to said boom substantially at said rotational axis, mast strut stabilizing means affixed to the transverse member and the mast, the entire structure rotating as a unit about the post.

4. A rotating mast assembly for a sailboat mounted on a substantially horizontal surface on a sailboat, a rotational axis for the assembly, said assembly comprising a mast, a releasable coupling on the mast, a mast step and vertical stabilizing bar means for the mast, said vertical stabilizing bars being widely spaced on the rotational axis and being angled forward to said mast, said stabilizing bars affixed to the mast partway above the mast step at said releasable coupling, said mast being positioned substantially forward of the rotational axis and a fore and aft sail whose head and track are affixed to the mast and the clew is affixed to a point on the assembly diametrically removed from the mast.

* * * * *